United States Patent [19]

Stangroom

[11] Patent Number: 4,493,615

[45] Date of Patent: Jan. 15, 1985

[54] ELECTRO-RHEOLOGICAL TRANSDUCER

[75] Inventor: James E. Stangroom, Castleton, England

[73] Assignee: National Research Development Corp., London, England

[21] Appl. No.: 557,581

[22] Filed: Dec. 2, 1983

[30] Foreign Application Priority Data

Dec. 3, 1982 [GB] United Kingdom ..... 8234634

[51] Int. Cl.[3] ..... F04B 37/02

[52] U.S. Cl. ..... 417/48

[58] Field of Search ..... 417/48, 320, 572; 415/219, 90; 406/99; 192/21; 418/4

[56] References Cited

U.S. PATENT DOCUMENTS 1,061,206 5/1913 Tesla ..... 415/90

3,561,907 2/1971 Campbell ..... 417/320

4,444,298 4/1984 Stangroom ..... 192/21 X

*Primary Examiner*—Edward K. Look

*Attorney, Agent, or Firm*—Cushman, Darby & Cushman

[57] ABSTRACT

A transducer with which mechanical rotary motion can be interconverted with the flow of an electro-rheological fluid. Two, electrically conductive, movable, conveying surfaces are partly disposed in parallel confrontation thereby defining a fluid transfer path. A fluid transfer port is located at each end of the fluid transfer path through which electro-rheological fluid can enter and leave the transducer. The conveying surfaces are electrically connected to a voltage source and movable by means of a rotor to which they are connected. On application of a voltage difference between the conveying surfaces the electro-rheological fluid gells after which rotation of the rotor will urge the fluid along the transfer path and vice-versa.

5 Claims, 6 Drawing Figures

ELECTRO-RHEOLOGICAL TRANSDUCER

TECHNICAL FIELD

This invention relates to electro-rheological transducers whereby mechanical rotary motion can be interconverted with the flow of an electro-rheological fluid.

BACKGROUND ART

An electro-rheological fluid is a slurry of finely-divided hydrophilic solids suspended in a hydrophobic liquid. The flow properties of such a slurry are dependent upon the strength of the electric field to which it is subjected. Up to a transition value of electric field the slurry behaves as a simple Newtonian liquid: for electric fields greater than the transition value, but less than that required to cause electrical breakdown, the fluid behaves approximately as a Bingham plastic, that is, no flow whatsoever is caused by shear stresses less than a yield stress which is dependent upon the fluid and on the applied field.

In many of the applications proposed for these fluids there is a requirement for either a pump capable of pumping an electro-rheological fluid around a fluid circuit or a rotary actuator powered by a supply of electro-rheological fluid under pressure. Preferably the device employed should not rely for its operation on close-fitting components, such as valve seats, that may become clogged by accumulations of solid particles coming out of suspension nor rely on intermeshing components, such as gears, which tend to grind the solids of the slurry thereby increasing the fluid's no-field viscosity.

DISCLOSURE OF INVENTION

It is an object of the present invention to provide an electro-rheological transducer capable of being used as an electro-rheological fluid pump or as an electro-rheological fluid powered rotary actuator having these preferred characteristics.

In accordance with the present invention a transducer for use with an electro-rheological fluid is characterised in that it includes— at least two electrically conductive, movable conveying surfaces mutually disposed, in part, in parallel confrontation and definining therebetween a fluid transfer path;

a rotor connected to move with at least one of the conveying surfaces;

two fluid transfer ports each in fluid communication with a respective end of the fluid transfer path; and an electrical connection means whereby control voltages are applicable to each of the two conveying surfaces.

The two fluid transfer ports allow electro-rheological fluid to enter and exit the transducer.

Preferably, the rotor is connected to move with both of the two conveying surfaces, those parts of the conveying surfaces that are in parallel confrontation being movable co-operatively.

The two conveying surfaces may respectively comprise the surface of the rotor and the inwardly facing surface of an endless metal belt looped around, but electrically insulated from, the rotor.

Alternatively, the conveying surfaces may be the confronting surfaces of a pair of endless metal belts looped around a common pair of rotors, the rotors being adapted to hold the belts parallel to each other for part of their extents and electrically insulated from one another.

BRIEF DESCRIPTION OF DRAWINGS

Embodiments of the invention will now be described by way of example with reference to the accompanying drawings, in which—

MODES OF CARRYING OUT THE INVENTION

Figure 1:
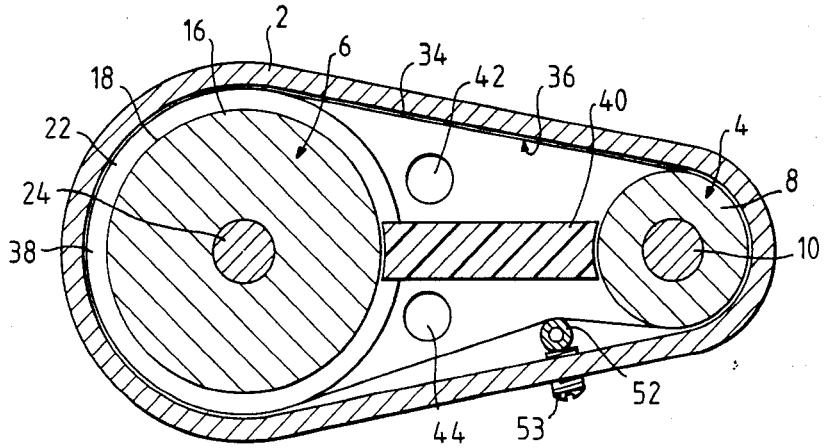
FIGS. 1 and 2 are simplified transverse and axial sections, respectively, of a first embodiment having a single fluid transfer path.
Figure 2:
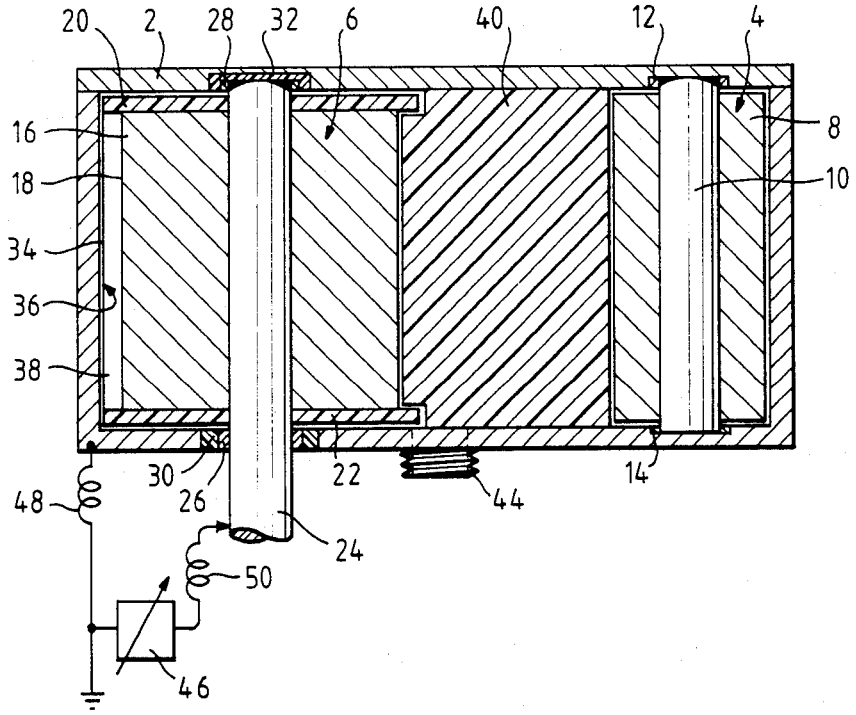

Referring to FIGS. 1 and 2, an electro-rheological transducer is shown which comprises a metal housing 2 in which are located a driven rotor 4 and a drive rotor 6. The driven rotor 4 comprises a cylindrical metal rotor body 8 fixed coaxially to a metal shaft 10 rotatably located, and electrically connected to, the housing 2 by bearings 12 and 14. The drive rotor 6 comprises a cylindrical metal rotor body 16 having a cylindrical surface 18 and two PTFE annuli 20 and 22 of larger radius than the rotor body 16 fixed coaxially to a metal shaft 24 rotatably located in the housing 2 by a sealed, journalled bearing 26 and a bearing 28.

The bearing 26 is set into a PTFE annullus 30 and the bearing 28 is set into a PTFE cup 32 so as to electrically isolate the shaft 24 and the rotor body 16 from the housing 2.

An endless metal belt 34 made of shim steel is looped around the rotor 4 and engages the two PTFE annuli 20 and 22 of the rotor 6 so as to have an inwardly facing surface 36 confronting the rotor body 16. The cylindrical surface 18 of the rotor body 16 and the inwardly facing surface 36 of the endless metal belt 34 form two conveying surfaces which are in parallel confrontation in the region where the metal belt 34 is held away from the rotor body 16 by the annuli 20 and 22 and define therebetween a fluid transfer path 38.

A planar PTFE wiper 40 is located within the housing 2 in the plane of the axes of the shafts 10 and 24. The wiper 40 is sealed to the housing 2 and forms a sliding seal with the rotors 6 and 8. An inlet port 42 and an outlet port 44 located one at each lateral side of the wiper 40 constitute two fluid transfer ports and permit electro-rheological fluid (not shown) to enter and exit the interior of the housing 2. The fluid entering by the inlet port 42 can pass from one lateral side of the wiper 40 to leave by the outlet port 44 at its other side only by passing along the fluid transfer path 38.

A source of variable electrical potential 46 is connected to the housing 2 and to the shaft 24 by leads 48 and 50, respectively, thereby allowing the application of selected control voltages to the two conveying surfaces 18 and 36. The housing 2 is conveniently held at earth potential.

A rod 52 extends transversely across the width of the endless metal belt 34. The rod is mounted in the housing 2 by a screw mounting of which one screw 53 is shown in FIG. 1. The lateral position of the rod 52 can be adjusted to alter the tension of the endless metal belt 34.

In operation the inlet and outlet ports 42 and 44 are connected to an electro-rheological fluid circuit (not shown) and the interior of electro-rheological transducer through which the fluid passes in moving from one port to the other is filled with electro-rheological fluid.

An electrical potential difference is established between the conveying surfaces 18 and 36, by means of the source 46, which is selected to be sufficiently large to cause the fluid in the fluid transfer path 38 to behave as a Bingham plastic, that is, as a flexible solid. Hereinafter, an electro-rheological fluid in this state will be referred to as a "gelled fluid". The electric field strength in all other parts of the enclosure will be below the transition value and so the fluid can flow freely through the ports 42 and 44 into or out of the housing 2.

If the electro-rheological transducer is to be used as a pump the shaft 24 is rotated by, for example, an electric motor (not shown). The shaft 24 is connected directly to the rotor body 16 and frictionally to the endless metal belt 34 by the annuli 20 and 22 and provides a drive means whereby the parallel, confronting parts of the conveying surfaces 18 and 36 may be moved co-operatively to urge the gelled fluid in the fluid transfer path 38 to move towards the outlet port 44. This gelled fluid being conveyed through the fluid transfer path 38 acts as a plunger to draw electro-rheological fluid in through the inlet port 42 and to expel the fluid out through the outlet port 44.

Alternatively, if the electro-rheological transducer is to be used as a rotary actuator, the inlet port 42 is connected to a source of electro-rheological fluid that is pressurised. The freely flowing fluid in the fluid circuit will urge the gelled fluid in the fluid transfer path 38 to move towards the outlet port 44 and, because the gelled fluid resists shear movement relative to them, the conveying surfaces 18 and 36 will be urged to move with the gelled fluid so exerting a torque on the shaft 24.

Figure 3:
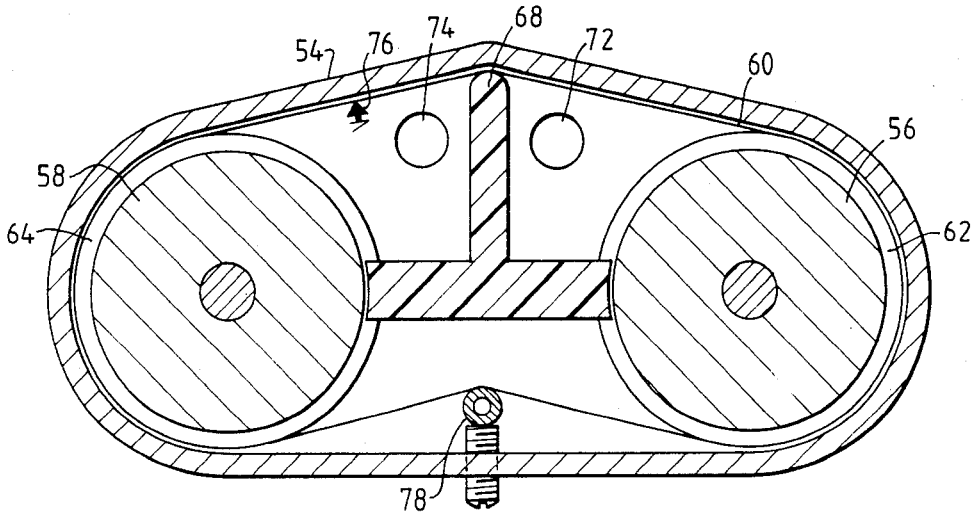
FIGS. 3 and 4 are simplified transverse and axial sections, respectively, of a second embodiment having two fluid transfer paths in series.
Figure 4:
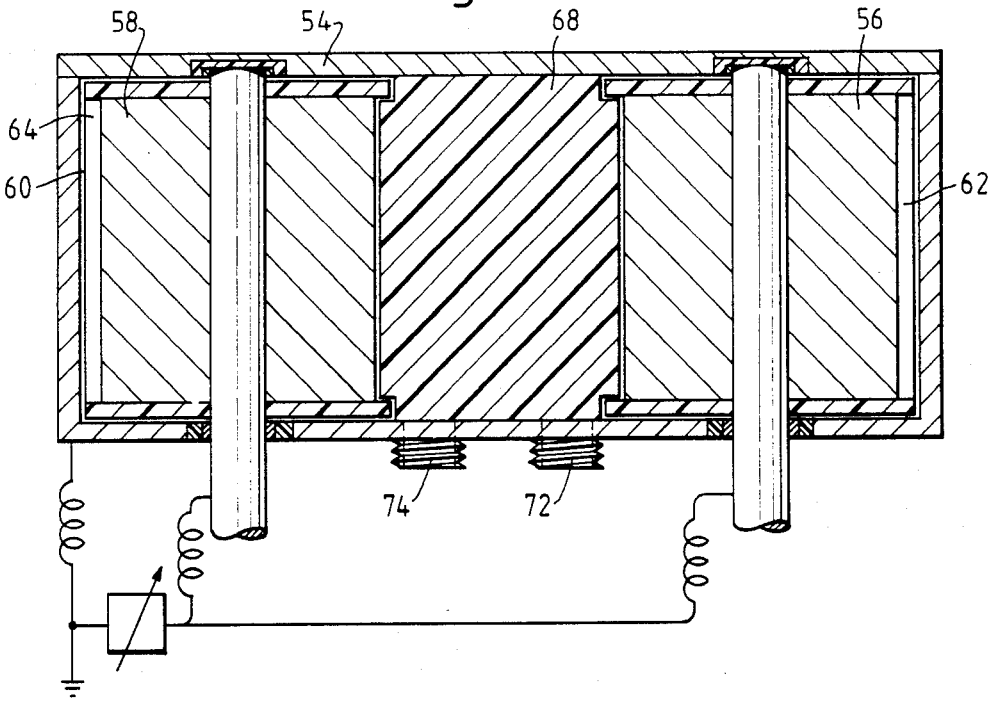

Referring now to FIGS. 3 and 4 an electro-rheological transducer is shown in which a housing 54 contains two drive rotors 56 and 58 each of which is identical to the drive rotor 6 of FIGS. 1 and 2 and respectively define with an endless metal belt 60 two, separated fluid transfer paths 62 and 64. A PTFE wiper 68 with a T-shaped transverse section is located in the housing 54. The wiper 68 is sealed to the housing 54 along its top and bottom edges and forms sliding seals with the endless metal belt 60 and the rotors 56 and 58. An inlet port 72 and an outlet port 74 are positioned in the housing 54 one on each side of the wiper 68 so that fluid passing from the inlet port 72 to the outlet port 74 must pass along the first fluid transfer path 62 and along the second fluid transfer path 64.

An electric potential is applied between the housing 54 and each rotor 56 and 58 in the manner described for the drive rotor 6 of the first embodiment. A sprung contract 76 is mounted on the interior of the housing 54 and resiliently held against the metal belt 60 to ensure that the belt 60 is held at the same potential as the housing 54 which is conveniently at earth potential.

A belt tensioner 78 similar to that of the embodiment shown in FIGS. 1 and 2 is mounted in the housing 54 so that the tension of the endless metal belt 60 can be adjusted.

The rotors 56 and 58 of this electro-rheological transducer are driven in synchronism by external gearing (not shown) the operation being similar to that of the electro-rheological transducer shown in FIGS. 1 and 2, except that there are two fluid transfer paths 62 and 64 in series where the fluid behaves as Bingham plastic rather than the single fluid transfer path 38 of the first embodiment shown in FIGS. 1 and 2.

Figure 5:
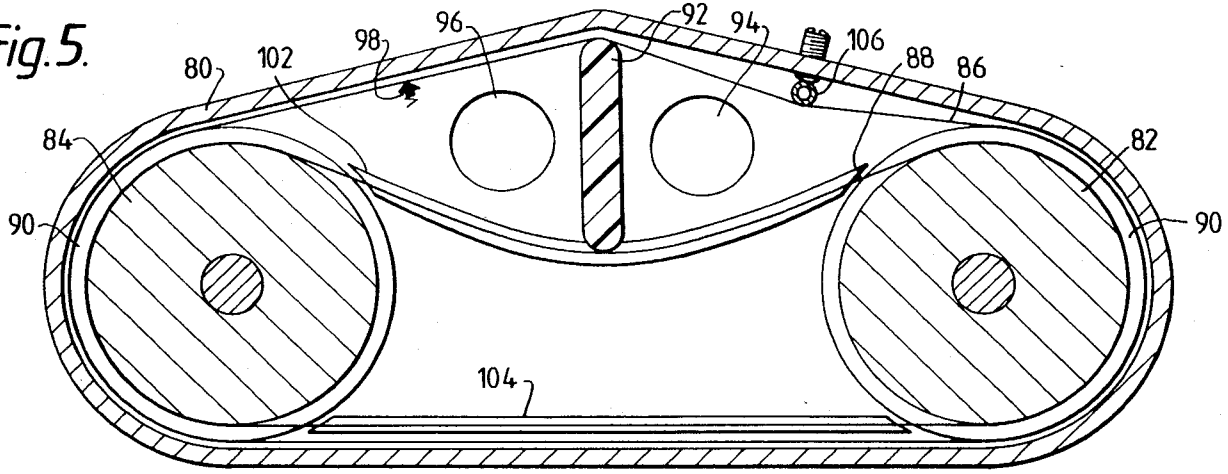
FIGS. 5 and 6 are simplified transverse and axial sections respectively, of a third embodiment having a single extended fluid transfer path defined by two confronting endless metal belts.
Figure 6:
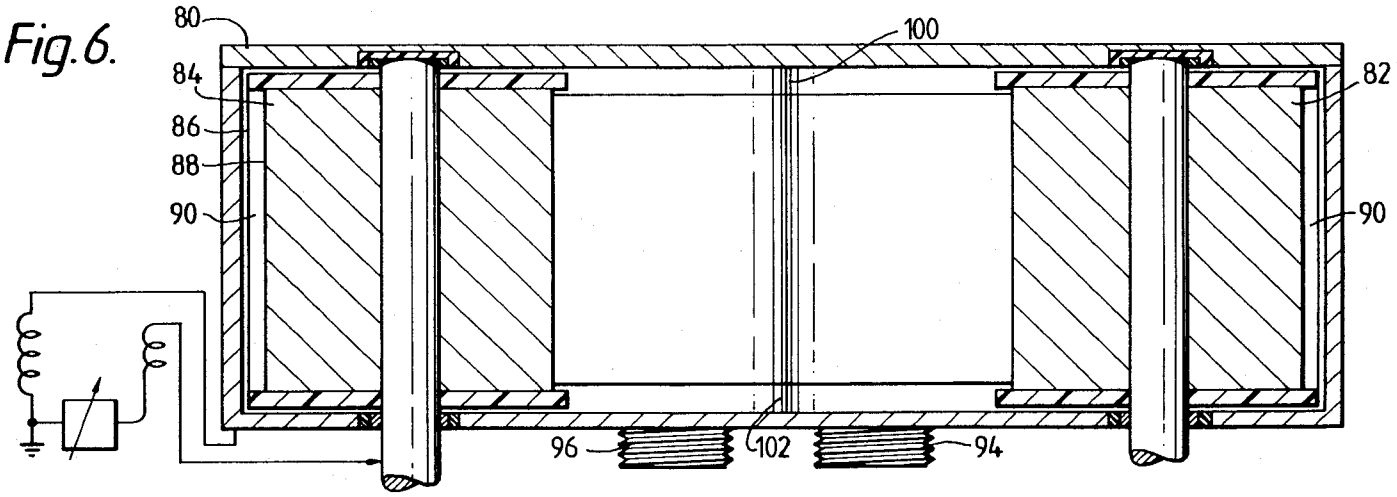

Referring now to FIGS. 5 and 6, an electro-rheological transducer is shown in which a housing 80 contains two drive rotors 82 and 84 each of which is identical to the drive rotor 6 of FIGS. 1 and 2. Two endless metal belts 86 and 88 are looped around the rotors 82 and 84 to define a single, extended fluid transfer path 90.

A planer PTFE wiper 92 located in the housing 80 is sealed along its top and bottom edges to the housing 80 and forms sliding seals with the metal belts 86 and 88. An inlet port 94 and an outlet port 96 are positioned in the housing 80 one on each lateral side of the wiper 92 so that fluid passing from the inlet port 94 to the outlet port 96 must pass along the length of the fluid transfer path 90.

A first paired set of PTFE guides 100 and 102 fixed to the housing 80 seals the endless belt 88 to the housing 80. A second paired set of PTFE guides (of which one, 104, is shown in FIG. 5) fixed to the housing 80 seals the endless belt 88 to the housing 80 and keeps the endless belts 86 and 88 apart.

The guides 100 and 102 are slightly curved so that the lateral edges of the endless metal belts 86 and 88 are pressed against them thereby improving the seal of the endless belts 86 and 88 to the guides 101 and 102.

A belt tensioner 106 similar to those of the preceding embodiments is mounted in the housing 80 so that the tension of the endless metal belt 80 can be adjusted.

An electric potential is applied between the housing 80 and each of the rotors 82 and 84 in the manner described for the drive rotors 56 and 58 of the second embodiment. A sprung contact 98 is mounted on the interior of the housing 82 and resiliently held against the metal belt 86 to ensure that the belt 86 is held at the same potential as the housing 80 which is conveniently at earth potential. The metal belt 86 is held at the same potential as the rotors 82 and 84 as it is in electrical contact with them.

The operation of the electro-rheological transducer shown in FIGS. 5 and 6 is similar to that of the first and second embodiments.

The three embodiments described above are reversible, that is, when used as a pump the direction of flow of the electro-rheological fluid in the transducer can be reversed by reversing the direction of rotation of the drive rotors and when used as a rotary actuator the drive rotors will rotate in the opposite direction if the flow of electro-rheological fluid through the transducer is reversed.

The rotors of an actuator according to this invention may be provided with one or more additional insulating annuli to act as spacers to support the endless metal belt in the region between the annuli at the ends of the rotors.

I claim:

1. A transducer for use with an electro-rheological fluid characterised in that there is included— at least two electrically conductive, movable conveying surfaces mutually disposed, in part, in parallel confrontation and defining therebetween a fluid transfer path;

a rotor connected to move with at least one of the conveying surfaces;

two fluid transfer ports each in fluid communication with a respective end of the fluid transfer path; and an electrical connection means whereby control voltages are applicable to each of the two conveying surfaces.

2. A transducer as claimed in claim 1 characterised in that the rotor is circumscribed by an endless belt, the two conveying surfaces being respectively comprised by the outer cylindrical surface of the rotor and the confronting inner surface of the endless belt.

3. A transducer as claimed in claim 2 characterised in that the endless belt is engaged with, and electrically insulated from, the rotor.

4. A transducer as claimed in claim 1 characterised in that the two conveying surfaces are respectively comprised by the confronting surfaces of two spaced-apart endless belts.

5. A transducer as claimed in claim 4 characterised in that both the endless belts circumscribe and engage the rotor.

* * * * *